United States Patent [19]

Shosie

[11] Patent Number: 4,917,285

[45] Date of Patent: Apr. 17, 1990

[54] DUAL CAPSTAN IN-LINE WIRE DRAWING MACHINE

[75] Inventor: Wayne A. Shosie, Rockford, Ill.

[73] Assignee: Rockford Manufacturing Group, Inc., Roscoe, Ill.

[21] Appl. No.: 375,127

[22] Filed: Jul. 3, 1989

[51] Int. Cl.[4] ..... B21C 1/12

[52] U.S. Cl. ..... 228/5.7; 228/13; 228/176; 228/904; 242/58.1; 242/78; 72/275; 72/289

[58] Field of Search ..... 228/5.7, 170, 176, 904, 228/13; 242/58.1, 78; 219/56; 72/275, 287, 289

[56] References Cited

U.S. PATENT DOCUMENTS

| | | | |
|---|---|---|---|
| 2,391,957 | 1/1946 | Fenner et al. | 242/78 |
| 2,557,215 | 6/1951 | Bruestle | 72/289 |
| 3,950,977 | 4/1976 | Uhlmann et al. | 72/289 |
| 4,099,403 | 7/1978 | Alcock et al. | 72/288 |
| 4,518,445 | 5/1985 | Pedersen et al. | 228/904 |
| 4,541,221 | 9/1985 | Seragnoli | 242/58.1 |

FOREIGN PATENT DOCUMENTS

| | | | |
|---|---|---|---|
| 63528 | 3/1988 | Japan | 242/78 |

*Primary Examiner*—Nicholas P. Godiei
*Assistant Examiner*—Samuel M. Heinrich
*Attorney, Agent, or Firm*—Leydig, Voit & Mayer

[57] ABSTRACT

A wire drawing machine having first and second capstans for unwinding wire from first and second coils and for pulling the wire through first and second wire drawing dies. The output from both capstans is directed to a single production machine, with the capstans alternately supplying the production machine so as to maintain a substantially continuous flow of wire to that machine.

11 Claims, 2 Drawing Sheets

DUAL CAPSTAN IN-LINE WIRE DRAWING MACHINE

BACKGROUND OF THE INVENTION

This invention relates generally to wire drawing and, more particularly, to a wire drawing operation of the type in which wire which is initially in a coil is unwound and is pulled through a drawing die in order to reduce the diameter of the wire. The wire then is supplied to a using or production machine such as a cold header which forms the wire into fasteners or the like.

Many wire drawing operations employ an in-line wire drawing machine of the type disclosed in Alcock et al U.S. Pat. No. 4,099,403. Such a machine includes a rotatable drum or capstan located between the drawing die and the production machine. The wire from the supply coil is threaded through the drawing die, is wrapped around the capstan and then is strung to the production machine.

In operation, the capstan is rotated to unwind the wire from the coil and to pull the wire through the drawing die. During such rotation, the wire is wound around the capstan. The production machine pulls the wire off of the capstan and consumes the wire at a rapid rate. The rotational speed of the capstan is matched to the demand of the production machine and, for this purpose, the capstan is rotated by a variable speed drive mechanism whose speed is trimmed in response to movement of a pivoted compensator arm which is biased into engagement with a loop of wire adjacent the capstan.

In some in-line drawing machines of the above type, the wire which leaves the capstan is guided between a pair of rotatable feed rolls. The feed rolls are used to advance the wire from the capstan toward the production machine during initial set up and prior to the time the production machine begins pulling the wire from the capstan.

When wire of relatively large diameter (e.g., $\frac{5}{8}$" or greater) is being handled, a significant time delay is encountered each time a coil of wire is depleted. As a coil nears depletion, it is necessary in many operations to shut down the line for a relatively long period of time in order to prepare the line to handle the next coil. For example, a new coil must be loaded into place, its leading end and the trailing end of the preceding coil must be prepared for welding and then the two ends must be welded, annealed and de-flashed. Such operations usually take between 15 and 30 minutes to accomplish and, during that time, the production machine must remain idle. In some cases, a coil only lasts 40 minutes and thus the production machine is idle a substantial percentage of the time. With the advent of faster, more sophisticated and more expensive production machines, the down time which occurs during coil changeover has become a far more critical factor than was the case in the past.

SUMMARY OF THE INVENTION

The general aim of the present invention is to provide a new and improved in-line wire drawing installation which is capable of running large diameter wire in such a manner that virtually no down time occurs during coil changeover.

A more detailed object of the invention is to achieve the foregoing through the provision of a unique in-line drawing machine having two alternately operable capstans, one of the capstans being used to supply the production machine while the other capstan is being set up to handle a new coil of wire.

Still another object is to provide a dual capstan in-line wire drawing machine in which the wire is uniquely cut between the production machine and the capstan nearing depletion and its leading end is held in a fixed position for subsequent re-feeding while the next coil is being attached to the trailing end of the wire.

The invention also resides in the novel use of the feed roll drive of the drawing machine to hold the cut wire in its fixed position.

A further object is to provide a wire drawing machine which enables the production machine to be quickly changed over to run a different size or type of wire.

These and other objects and advantages of the invention will become more apparent from the following detailed description when taken in conjunction with the accompanying drawings.

DETAILED DESCRIPTION OF THE PREFERRED EMBODIMENT

Figure 1:
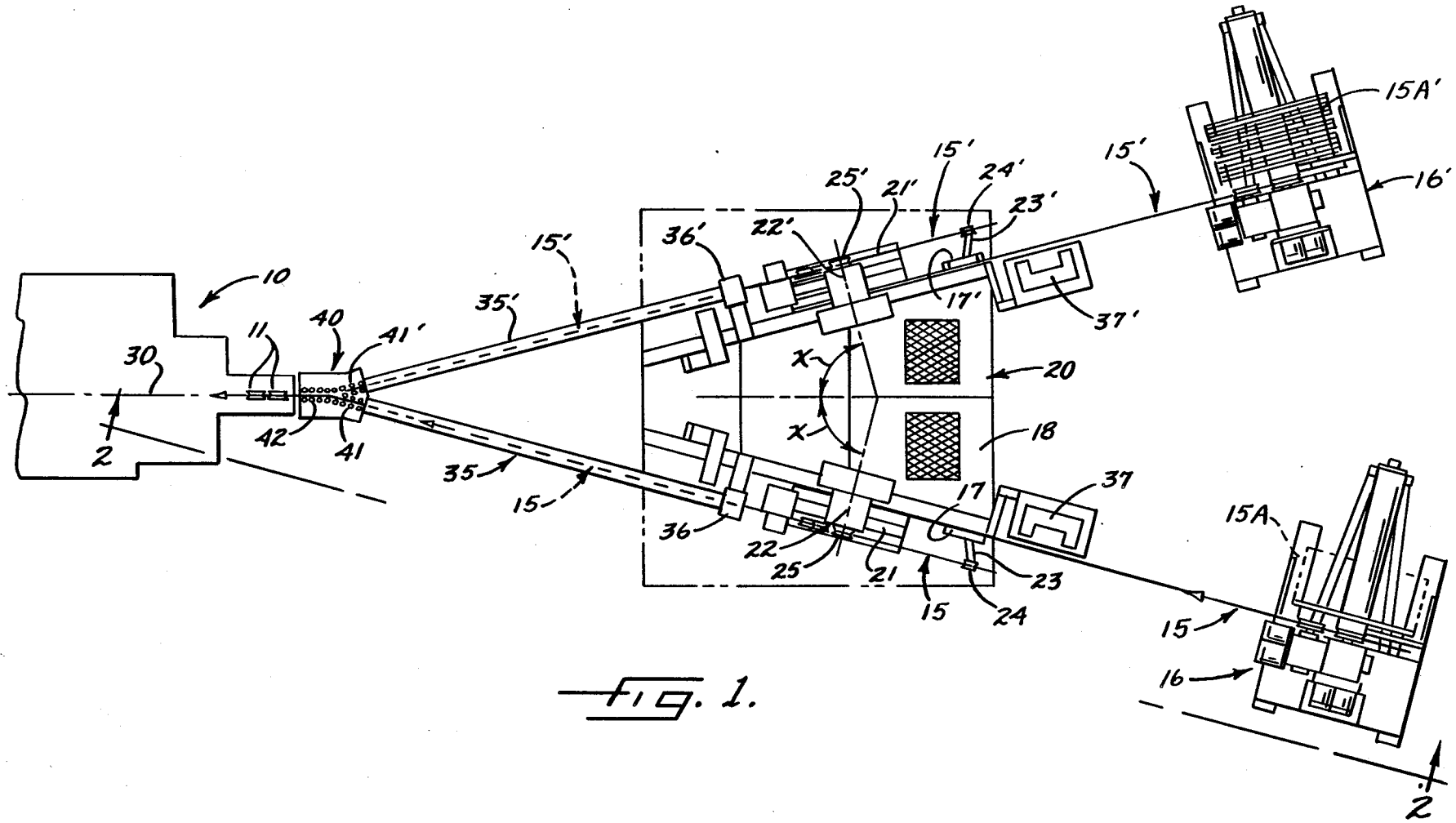
FIG. 1 is a top plan view which diagrammatically shows a new and improved dual capstan wire drawing machine supplying wire to a typical production machine.

For purposes of illustration, the invention has been shown in the drawings in connection with a system in which wire is reduced in diameter and is supplied to a production or using machine 10 which further processes the wire as, for example, by converting the wire into fasteners such as screws or nails. The production machine may be a bolt making machine, a cold header or any other machine which consumes wire.

Typically, the production machine 10 controls the rate at which wire is fed to the machine. For this purpose, the production machine is equipped with one or more pair of opposing power-rotated feed rolls 11 (FIGS. 1 and 2) between which the wire is threaded. As the rolls rotate, they pinch the wire between them and advance the wire to the wire-processing components of the production machine.

Wire 15 initially is wound in a coil 15A (FIG. 1) which is rotatably supported by a conventional uncoiler 16. From the uncoiler 16, the wire 15 extends to and through a drawing die 17 which is fixed on the support or frame 18 of an in-line wire drawing machine 20. The die acts to reduce the diameter of he wire 15 as the wire is pulled through the die. Such pulling is effected by a power-rotated capstan 21 which, in this particular instance, is journaled on the frame 18 to turn about a horizontal axis 22 (FIG. 1). The wire 15 from the die 17 is wrapped around the capstan; the wire on the capstan being in the form of a coil composed of a number of wraps in a single layer.

When the capstan 21 is rotated, an entering length of wire is pulled from the die 17 and onto one end portion (the entrance end portion) of the capstan. At the other end portion (the exit end portion) of the capstan, an exiting length of wire 15 is uncoiled from the capstan and is formed into a loop 15B (FIG. 2) by a pivoted compensating arm 23. A grooved wheel 24 is supported rotatably on the upper end portion of the arm 23 and engages the loop. The arm 23 is biased by springs (not visible) to swing in a clockwise direction and thus the wheel 24 tends to increase the size of the loop 15B.

The compensating arm 23 controls the rotational speed of the capstan 21 in accordance with the rate at which wire 15 is delivered to the production machine 10 by the feed rolls 11. If the feed rate increases, the loop becomes smaller and causes the compensating arm to pivot in a counterclockwise direction. Such pivoting is detected by a well known control (not shown) which acts to increase the capstan 21 to a speed matching the consumption rate of the production machine 10. Conversely, the loop becomes larger and the compensating arm pivots in a clockwise direction to reduce the speed of the capstan when the wind demand of the production machine decreases.

Figures 2, 3, 4, 5, 6:
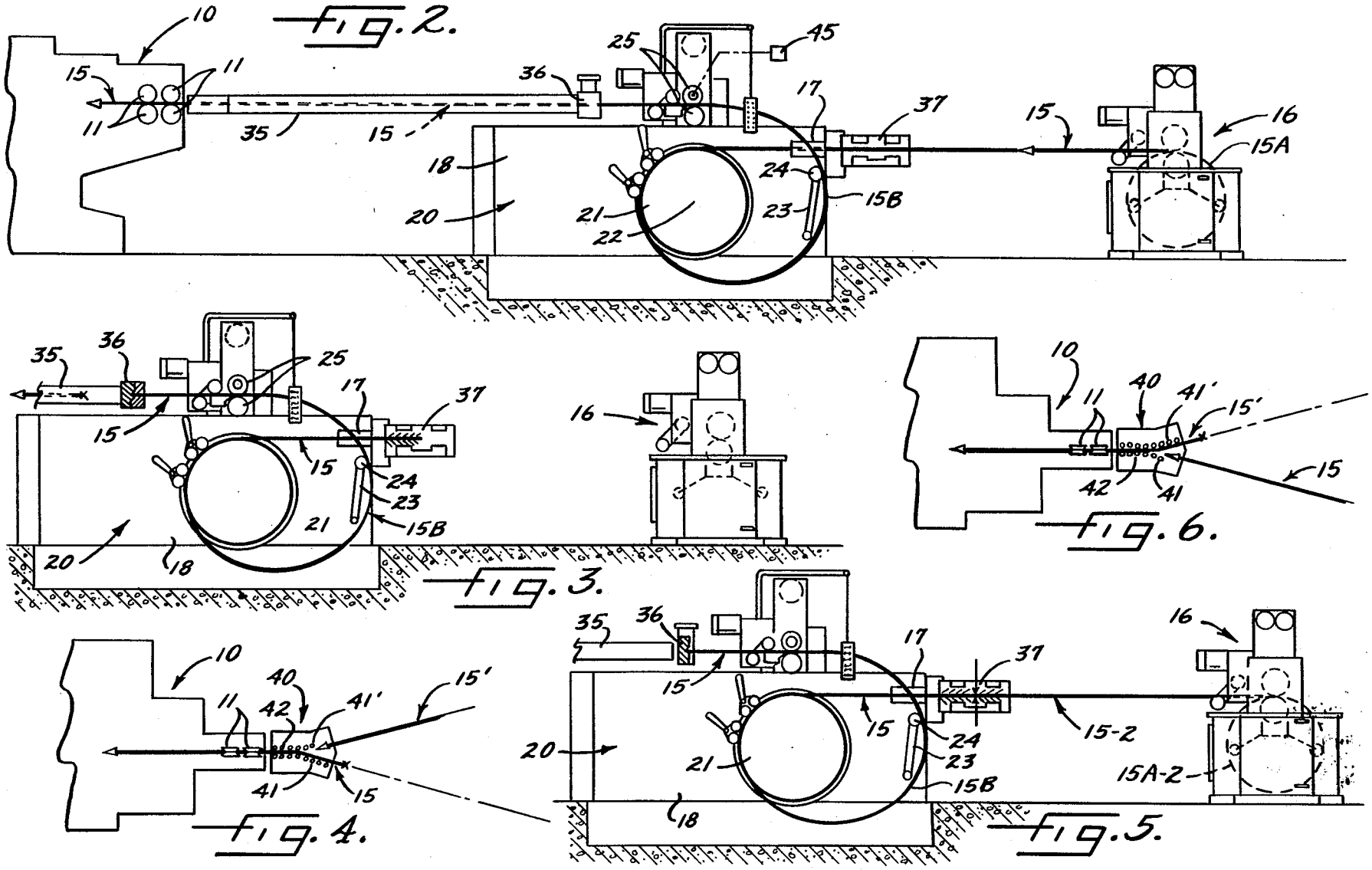
FIG. 2 is a side elevational view of the installation as seen along the line 2—2 of FIG. 1.
FIG. 3 is a fragmentary view similar to FIG. 2 but shows the wire drawing machine when the wire on one of the capstans (e.g., the first capstan) is nearing depletion.
FIG. 4 is a fragmentary top plan view of an area adjacent the production machine and diagrammatically shows the conditions which exist just as the supply of wire from the first capstan is being terminated and just prior to the supply of wire from the second capstan being started.
FIG. 5 is a view similar to FIG. 3 but shows the first capstan being set up to again supply wire to the production machine.
FIG. 6 is a view similar to FIG. 4 but shows the conditions which exist adjacent the production machine just as the supply of wire from the second capstan is being terminated and just prior to the supply of wire from the first capstan being re-started.

As shown in FIG. 2, the present wire drawing machine 20 includes a pair of opposing feed rolls 25 downstream of the loop 15B and just above the capstan 21. The feed rolls 25 are adapted to be power-rotated but are driven under power only for the purpose of advancing the wire 15 from the capstan 21 to the feed rolls 11 of the production machine 10. During operation of the production machine when the wire 15 is pulled by the feed rolls 11, the feed rolls 25 simply turn idly as the wire passes between them.

As described thus far, the wire drawing machine 20 is substantially the same as disclosed in. Alcock et al U.S. Pat. No. 4,099,403. When such a machine is used to handle wire 15 having a diameter greater than 178 ", substantial delay occurs when the coil 15A of wire on the uncoiler 16 nears depletion. As the coil 15A nears depletion, it is necessary in conventional practice to shut down the production machine 10 and the wire drawing machine 20 before the trailing end of the wire of the coil reaches the drawing die 17. During the period of shut down, it is necessary to load a new coil of wire onto the uncoiler 16, to prepare the leading end of the wire of the new coil and the trailing end of the wire of the depleted coil for welding, to weld such ends together, to anneal the weld and then to remove the flash resulting from the weld. These procedures can take between 15 and 30 minutes and, under conventional practice, the production machine 10 sits idle and thus substantial production is lost.

In accordance with the present invention, the down time of the production machine 10 is reduced substantially through the provision of a new and improved wire drawing machine 20 having dual lines for supplying the production machine. When the wire being supplied by one line is depleted, such line is shut down and the second line is immediately started. That line supplies the production machine while the first line is being set up with a new coil of wire. When the wire from the second line is depleted, the replenished first line is restarted and, in this manner, wire is supplied to the production machine on a substantially continuous basis so as to minimize the down time of the production machine.

The first line of the drawing machine 20 includes the components described above. The second line includes identical components which have been designated by primed reference numerals. Thus, the second line includes an uncoiler 16' (FIG. 1) for a coil 15A', a drawing die 17' on the frame 18, a capstan 21' supported on the frame 18 and rotatable about a horizontal axis 22', a compensator arm 23' with a wheel 24' and a pair of feed rolls 25'.

The components of the two lines are arranged such that the wires 15 and 15' supplied by the two lines lie along the sides of a V whose apex is located just upstream of the feed rolls 11 of the production machine 10, the V being symmetrical with respect to the longitudinal centerline 30 of the production machine. For this purpose, the two capstans 21 and 21' are positioned on the frame 18 with their axes 22 and 22' inclined at an acute angle X relative to the longitudinal centerline 30. Thus, the capstans are located such that their axes 22 and 22' diverge away from one another in the downstream direction. In this particular instance, the angle X is about 75 degrees.

In addition to the components which have been described, the two lines include wire guides 35, 35'; automatic cutters 36, 36' and welders 37, 37' (FIGS. 1 and 2). The wire guide 35, 35' of each line is attached to the frame 18 downstream of the feed rolls 25, 25' and comprises a tube for directing the wire 15, 15' from the capstan 21, 21' to the production machine 10. Located immediately downstream of the guide tubes 35 and 35' and immediately upstream of the production machine 10 is a Y-guide 40 for directing wire 15 or 15' from either line alternately to the production machine. Basically, the Y-guide includes first and second angled guide paths 41 and 41', respectively, which receive the wires 15 and 15', respectively; which converge in a downstream direction; and which meet one another at a common point. Extending downstream from that point and lying along the centerline 30 of the production machine 10 is a third guide path 42 which leads to the feed rolls 11. Thus, the wire 15 may be supplied to the feed rolls 11 via the guide tube 35, the guide path 41 and the guide path 42. In the absence of the wire 15, the wire 15' may be supplied to the feed rolls 11 by way of the guide tube 35', the guide path 41' and the guide path 42.

The cutter 36, 36' for each line is located on the frame 18 just upstream of the guide tube 35, 35'. Each cutter may be operated manually or may be operated automatically upon receipt of an electrical signal. When operated, the cutter 36, 36' acts to cut the wire 5, 15' at a point between the feed rolls 25, 25' and the guide tube 35, 35'.

The welder 37, 37' for each line is mounted on the frame 18 and is located upstream of the respective drawing die 17, 17'. When operated, the welder serves to weld the leading end of a new coil to the trailing end of a coil 15A, 15A' which is approaching depletion.

Means are provided for holding the wire 15, 15' of each line adjacent the cutter 36, 36' after the wire has been cut, such means preventing the end portion of the wire from being pulled rearwardly past the feed rolls by the tension of the wire coiled around the capstan 21, 21'. While these means could take various forms such as clamps or the like, the holding action on each wire is preferably effected by a one-way clutch 45 associated with the drive shaft for one of the feed rolls 25, 25' of that wire. Such a clutch has been illustrated in block form in FIG. 2 in connection with the upper feed roll 25, it being understood that a similar clutch is associated with the upper feed roll 25' and that the lower feed rolls may be connected to the upper feed rolls by gears (not shown). The clutch is such that it permits the upper feed roll to be rotated in a direction to advance the wire downstream but prevents the feed roll from turning in the opposite direction. Accordingly, after the wire has been cut, the locked feed roll prevents the highly tensioned wire on the capstan from pulling the leading end portion of the wire reversely away from the cutter and reversely through the feed rolls 25, 25'.

To explain the operation of the installation as described above, let it be assumed that the first line (i.e., the line which includes the uncoiler 16 and the capstan 21) is fully set up and operating and is supplying wire 15 to the production machine 10 (see FIGS. 1, 2 and 4). Let it further be assumed that the second line has been set up with wire 15' and is in a standby condition with the leading end of such wire extending through the guide tube 25' and just poking into the guide path 41' of the Y-guide 40 (see FIG. 4).

During operation of the first line, the capstan 21 pulls wire 15 from the coil 15A and through the drawing die 17, such wire being wound on the capstan. The wire 15 then extends from the capstan 21, between the feed rolls 25, past the cutter 36, through the guide tube 35, and along the guide paths 41 and 42 of the Y-guide 40 to the feed rolls 11. As such feed rolls rotate, they pull the wire 15 from the capstan 21 and supply the wire to the production machine 10.

Now assume that the wire 15 of the coil 15A of the first line approaches depletion. When the trailing end of the wire 15 is detected (either visually or automatically), the feed rolls 11 of the production machine 10 are stopped. When the feed rolls 11 stop, the compensator arm 23 causes the capstan 21 to stop. Such stopping preferably occurs when the trailing end of the wire 15 is located adjacent the welder 37 at a position between the drawing die 17 and the uncoiler 16 (see FIG. 3).

As soon as the wire 15 stops, it is cut by the cutter 36 at a point between the guide tube 35 and the feed rolls 25 (see FIG. 3). The clutch 45 on the upper feed roll 25 causes the feed rolls to hold the wire against being pulled reversely away from the cutter.

Once the wire 15 has been cut, rotation of the feed rolls 11 is resumed to cause those feed rolls to supply the remaining length of wire 15 to the production machine 10 (see FIG. 3). After such wire has been consumed, the feed rolls 25' of the second line are rotated momentarily in order to advance the leading end portion of the wire 15' into the guide path 42 of the Y-guide 40 and then to the feed rolls 11. Once the latter feed rolls take control of the wire 15', the operation proceeds as described above but with the production machine 10 being supplied by the second line.

During the time the second line is active, a new coil 15A-2 (FIG. 5) of wire 15-2 is loaded onto the uncoiler 16 and its leading end is strung to a position adjacent the welder 37 (see FIG. 5). Thereafter, the leading end of the wire 15-2 and the trailing end of the wire 15 are welded together in order to place the coil 15A-2 in the system. While the welding is taking place, the leading end of the wire 15 may be chamfered (either manually or automatically) to prepare the end for feeding to the production machine 10. After the welding and chamfering have been completed, the feed rolls 25 are driven for a short time to advance the leading end of the wire 15 into the guide path 41 of the wire guide 40 at a standby position awaiting depletion of the wire 15' from the second line (see FIG. 6). The cycle then repeats as described above but with the second line being shut down and the first line being started up when the second wire 15' is depleted.

While the standby position has been specifically described as being with the wire poking into the Y-guide, the standby position could be just downstream of the feed rolls 25, 25' or at any position between those feed rolls and the Y-guide.

From the foregoing, it will be apparent that the present invention brings to the art a new and improved in-line wire drawing machine 20 having dual capstans 21 and 21' and capable of effecting a significant reduction in the down time of the production machine 10. While the dual capstan machine has specifically been described in connection with facilitating the joining of coils of large diameter wire, the machine also may be used to advantage with small diameter wire of ½" or less. With small diameter wire, a flipper-type uncoiler may be used with a single capstan wire drawing machine to facilitate the joining of ends of consecutive coils without any substantial interruption of the production machine. Thus, a dual capstan machine is not usually necessarily advantageous with small diameter wire from the standpoint of wire joining. The dual capstan machine may, however, be used to advantage to reduce the time required to change over the installation from running one size of small wire to running another size of small wire. In such an instance, the first line can be set up to supply wire of one size, the second line can be set up to supply wire of another size, and the second line may be placed in a standby condition so as to be ready for operation immediately upon shut down of the first line. The machine may also be run in this manner with wire of the same size if the specifications are such that welded joints in the wire are not permitted.

I claim:

1. Apparatus for drawing a length of wire through a die and for supplying the wire to a production machine, said apparatus comprising a support, a capstan rotatably mounted on said support, said capstan having an entrance end for receiving wire from said die and having an exit end from which wire is supplied to said production machine, feeding means on said support and located downstream of the exit end of said capstan for feeding wire from said capstan toward said production machine, cutting means located on said support between said feeding means and said production machine and selectively operable to cut said wire, and means for preventing said wire from being pulled reversely past said feeding means after the wire has been cut by said cutting means..

2. Apparatus as defined in claim 1 for drawing a second wire through a second die and for supplying the second wire to said production machine, said apparatus further including a second capstan rotatably mounted on said support, said second capstan having an extrance end for receiving said second wire from said second die and having an exit end from which said second wire is supplied to said production machine, second feeding means on said support and located downstream of the exit end of said second capstan for feeding said second wire from said second capstan toward said production machine, second cutting means located on said support between said second feeding means and said production machine and selectively operable to cut said second wire, and means for preventing said second wire from being pulled reversely past said second feeding means after said second wire has been cut by said second cutting means.

3. Apparatus as defined in claim 2 further including first guide means for directing wire from said first feeding means toward said production machine, second guide means for directing wire from said second feeding means toward said production machine, said first and second guide means converging toward a common point adjacent said production machine as said first and second guide means progress downstream from said first and second feeding means, respectively.

4. Apparatus as defined in claim 3 further including a Y-guide located between said guide means and said production machine, said Y-guide having first and second guide paths adapted to receive said first and second wires, respectively, said first and second guide paths converging in a downstream direction and substantially meeting one another at said common point, and said Y-guide having a third guide path extending from said common point to said production machine and adapted to alternately receive said first and second wires.

5. Apparatus as defined in claim 2 further including first and second uncoilers for supplying said first and second wires to said first and second dies, respectively, a first welder on said support between said first uncoiler and said first die, and a second welder on said support between said second uncoiler and said second die, each of said welders being adapted to weld the trailing end of one coil of wire to the leading end of another coil of wire.

6. Apparatus as defined in claim 2 in which each of said feeding means comprises a pair of opposing feed rollers located in pinching engagement with the respective wire, one of the feed rollers of each pair being rotatable in one direction to feed the respective wire, and a one-way clutch associated with said one roller of each pair and operable to prevent such roller from rotating in the opposite direction, said clutches constituting said means for preventing said wires from being pulled reversely.

7. Apparatus for supplying wire to a production machine, said apparatus comprising a support, first and second drawing dies mounted on said support, first and second capstans mounted on said support to rotate about first and second axes, respectively, said first and second capstans being operable to draw first and second wires, respectively, through said first and second dies, respectively, each of said capstans having an entrance end for receiving the respective wire from the respective die and having an exit end from which the respective wire is supplied to said production machine, said first and second axes being positioned on said support such that said first and second wires from said first and second capstans, respectively, extend along first and second paths, respectively, which converge toward one another as said paths progress downstream from said capstans toward said production machine.

8. A wire drawing installation for reducing the diameter of wire and for supplying the wire to a production machine, said installation comprising first and second wire handling lines, each of said lines comprising:

(A) means for storing a coil of wire,
(B) a wire drawing die,
(C) a rotatable capstan for pulling wire from said coil and through said die to reduce the diameter of the wire,
(D) means for feeding wire from the capstan,
(E) means for preventing the wire from traveling reversely toward the capstan, and
(F) guide means for directing the wire fed from the capstan, the guide means for each line being located to direct the wire fed from the respective capstan to a common point just upstream of said production machine whereby the wires from the two capstans may be supplied alternately to the machine, said installation further comprising means for cutting each wire at a position between said point and the feeding means of the respective line, and welding means upstream of said dies for welding the trailing end of the wire of the coil of each line to the leading end of the wire of a new coil placed on the storing means of such line.

9. A method of supplying wire to a production machine, said method comprising the steps of, rotating a first capstan in one direction to pull wire from a first coil through a first drawing die and to wind the wire around the capstan, unwinding the wire from the capstan and feeding the wire from the capstan toward the production machine, stopping feeding of the wire before the trailing end of the wire from the coil reaches said capstan, cutting the wire between the production machine and the capstan to leave a length of wire extending from the capstan toward the production machine, preventing said length of wire from traveling reversely from said production machine toward said capstan, welding the leading end of an additional coil of wire to the trailing end of said first coil, and resuming feeding of said wire to advance said length of wire toward said production machine.

10. A method as defined in claim 9 further including the step of supplying wire from a second coil to said production machine during at least part of the time period during which feeding of said first wire is stopped.

11. A method as defined in claim 10 in which wire is supplied from said second coil to said production machine by (a) rotating a second capstan in one direction to pull wire from said second coil through a second drawing die and to wind the second wire around said second capstan, and (b) unwinding the second wire from the second capstan and feeding the second wire from the second capstan to the production machine, said method further comprising the steps of, stopping feeding of the second wire before the trailing end of the wire from the second coil reaches the second capstan, cutting the second wire between the second capstan and the production machine to leave a length of second wire extending from the second capstan toward the production machine, preventing length of second wire from traveling reversely from said production machine toward said second capstan, welding the leading end of still another coil of wire to the trailing end of said second coil, and resuming feeding of said second wire to advance said length of second wire toward said production machine.

* * * * *